US010758781B1

(12) United States Patent
O'Grady

(10) Patent No.: US 10,758,781 B1
(45) Date of Patent: Sep. 1, 2020

(54) HAND CONTROL DEVICE FOR SWIMMERS

(71) Applicant: John O'Grady, La Canada, CA (US)

(72) Inventor: John O'Grady, La Canada, CA (US)

( * ) Notice: Subject to any disclaimer, the term of this patent is extended or adjusted under 35 U.S.C. 154(b) by 0 days.

(21) Appl. No.: 16/294,215

(22) Filed: Mar. 6, 2019

(51) Int. Cl.
*A63B 31/10* (2006.01)

(52) U.S. Cl.
CPC ..... *A63B 31/10* (2013.01); *A63B 2208/02* (2013.01); *A63B 2208/03* (2013.01); *A63B 2225/60* (2013.01); *A63B 2244/20* (2013.01)

(58) Field of Classification Search
CPC . A63B 31/10; A63B 2208/02; A63B 2208/03; A63B 2225/60; A63B 2244/20
See application file for complete search history.

(56) References Cited

U.S. PATENT DOCUMENTS

| | | | | |
|---|---|---|---|---|
| 10,052,523 | B2 * | 8/2018 | Kim | H04N 5/2252 |
| 10,269,263 | B2 * | 4/2019 | Carrick | G09B 15/06 |
| 2003/0070669 | A1 * | 4/2003 | Beville | F41B 5/10 124/88 |
| 2015/0096427 | A1 * | 4/2015 | Nadolny | G10K 1/074 84/406 |
| 2017/0095697 | A1 * | 4/2017 | Winograd | A63B 31/10 |
| 2018/0214742 | A1 * | 8/2018 | Harrison | A47B 21/0371 |

* cited by examiner

*Primary Examiner* — Stephen P Avila
(74) *Attorney, Agent, or Firm* — Cotman IP Law Group

(57) ABSTRACT

A hand control device for swimmers is presented. The device has a main body with two holes in a side-by-side configuration. The first one of the two holes is configured for a third digit of a person's hand while the second one of the two holes is configured for a fourth digit of the person's hand. The inside surface of each hole comprises a plurality of grooves that run depthwise thereby providing wet traction while impacting minimum direct pressure on the nerves, vessels and tendons. The outside surface of the device may also include ridges to provide pass through for water.

5 Claims, 3 Drawing Sheets

HAND CONTROL DEVICE FOR SWIMMERS

BACKGROUND OF THE INVENTION

Field of the Invention

Embodiments of the invention relates to equipment for competitive sports. More specifically, the invention relates to hand control device for swimmers.

Description of the Related Art

There are currently no known devices for controlling the fingers of a swimmer to improve competitiveness.

Participants in swimming activities, especially the less experienced swimmers tend to hold the fingers in each hand together while swimming. This may be because of the mistaken belief that holding the fingers together helps displace more water thus propelling the swimmer faster. The problem with this practice is that because the fingers are held together, it decreases drag of the hands through the water thus slowing down the immersion of the swimmer's hands into the water and increasing fatigue.

This slowing down of the swimmer's hands as they cut through the water may be the difference between winning and losing a competitive swimming event. A review of the world-class swimmers reveal the conscious spread of their fingers while competing.

To overcome the problems and limitations described above there is a need for a device that controls the spread of a swimmer's fingers.

BRIEF SUMMARY OF THE INVENTION

One or more embodiments of the invention are directed a hand control device for swimmers. The device may be configured as a main body with two rings coupled together in a side-by-side configuration. The device may also be configured as an oval or rectangular body with two holes in a side-by-side configuration. Other embodiments of the device may be configured as a main body with one or more holes.

In one or more embodiments, each hole of a ring is configured for a digit of a person's hand. For instance, in configurations with two rings, the first ring may be configured for the third digit of a person's hand and the second ring is configured for the fourth digit of the person's hand.

In one or more embodiments, each ring's inside surface comprises a plurality of grooves that run depthwise and configured for providing wet traction while impacting minimum direct pressure on the nerves, vessels and tendons.

In one or more embodiments, the main body comprises resilient material, e.g. silicon.

One or more embodiments of the device may also comprises one or more ridges on the outside surface of the ring. The body of the ring is configured to provide optimum separation between two fingers.

BRIEF DESCRIPTION OF THE DRAWINGS

The above and other aspects, features and advantages of the invention will be more apparent from the following more particular description thereof, presented in conjunction with the following drawings wherein.

DETAILED DESCRIPTION

Figure 1A:
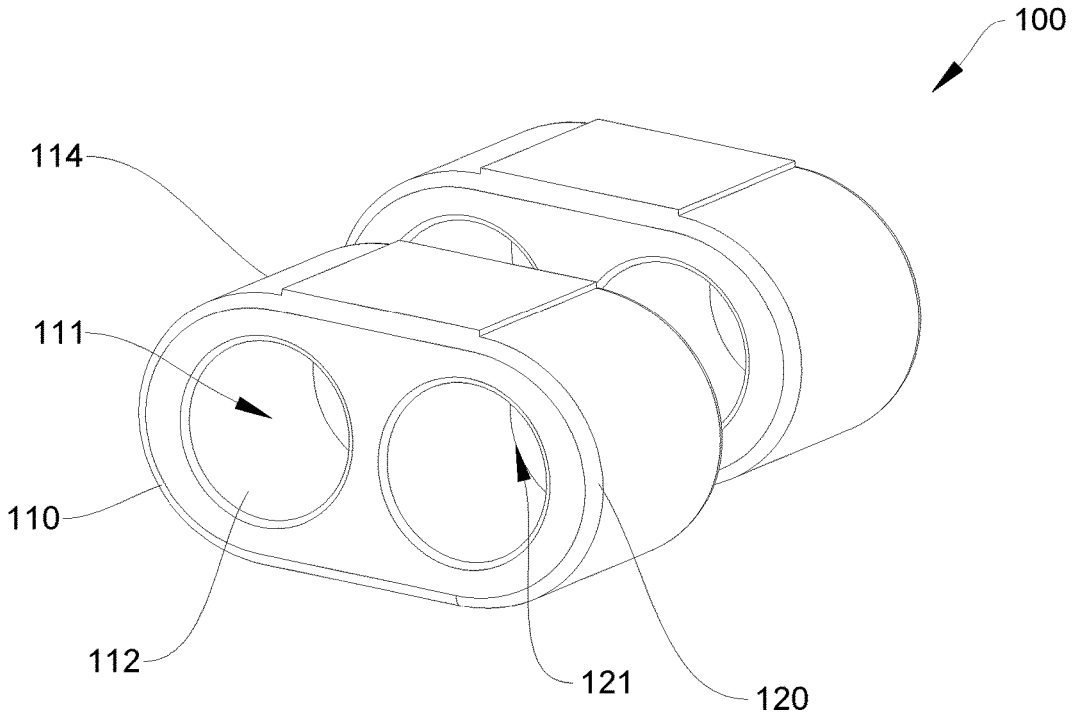
FIG. 1A is a perspective view of the hand control device in accordance with one or more embodiments of the present invention.

The present invention comprising a hand control device for swimmers will now be described. In the following exemplary description numerous specific details are set forth in order to provide a more thorough understanding of embodiments of the invention. It will be apparent, however, to an artisan of ordinary skill that the present invention may be practiced without incorporating all aspects of the specific details described herein. Furthermore, although steps or processes are set forth in an exemplary order to provide an understanding of one or more systems and methods, the exemplary order is not meant to be limiting. One of ordinary skill in the art would recognize that the steps or processes may be performed in a different order, and that one or more steps or processes may be performed simultaneously or in multiple process flows without departing from the spirit or the scope of the invention. In other instances, specific features, quantities, or measurements well known to those of ordinary skill in the art have not been described in detail so as not to obscure the invention. It should be noted that although examples of the invention are set forth herein, the claims, and the full scope of any equivalents, are what define the metes and bounds of the invention.

For a better understanding of the disclosed embodiment, its operating advantages, and the specified object attained by its uses, reference should be made to the accompanying drawings and descriptive matter in which there are illustrated exemplary disclosed embodiments. The disclosed embodiments are not intended to be limited to the specific forms set forth herein. It is understood that various omissions and substitutions of equivalents are contemplated as circumstances may suggest or render expedient, but these are intended to cover the application or implementation.

The term "first", "second" and the like, herein do not denote any order, quantity or importance, but rather are used to distinguish one element from another, and the terms "a" and "an" herein do not denote a limitation of quantity, but rather denote the presence of at least one of the referenced item.

Spatially relative terms, such as "beneath," "below," "lower," "under," "above," "upper," and the like, may be used herein for ease of explanation to describe one element or feature's relationship to another element(s) or feature(s) as illustrated in the figures. It will be understood that the spatially relative terms are intended to encompass different orientations of the device in use or in operation, in addition to the orientation depicted in the figures. For example, if the device in the figures is turned over, elements described as "below" or "beneath" or "under" other elements or features would then be oriented "above" the other elements or features. Thus, the example terms "below" and "under" can encompass both an orientation of above and below. The device may be otherwise oriented (e.g., rotated 90 degrees or at other orientations) and the spatially relative descriptors used herein should be interpreted accordingly.

It will be understood that when an element or layer is referred to as being "on," "connected to," or "coupled to" another element or layer, it can be directly on, connected to, or coupled to the other element or layer, or one or more intervening elements or layers may be present. In addition, it will also be understood that when an element or layer is referred to as being "between" two elements or layers, it can be the only element or layer between the two elements or layers, or one or more intervening elements or layers may also be present.

As used herein, the term "substantially," "about," and similar terms are used as terms of approximation and not as terms of degree, and are intended to account for the inherent deviations in measured or calculated values that would be recognized by those of ordinary skill in the art. Further, the use of "may" when describing embodiments of the present invention refers to "one or more embodiments of the present invention." As used herein, the terms "use," "using," and "used" may be considered synonymous with the terms "utilize," "utilizing," and "utilized," respectively. Also, the term "exemplary" is intended to refer to an example or illustration.

Unless otherwise defined, all terms (including technical and scientific terms) used herein have the same meaning as commonly understood by one of ordinary skill in the art to which the present invention belongs. It will be further understood that terms, such as those defined in commonly used dictionaries, should be interpreted as having a meaning that is consistent with their meaning in the context of the relevant art and/or the present specification, and should not be interpreted in an idealized or overly formal sense, unless expressly so defined herein.

One or more embodiments of the present invention will now be described with references to FIGS. 1-3.

The hand control device is ergonomically and appropriately configured to address the finger configurations of a person's hand. The device is intended to optimize the aerodynamic characteristics and reduce fatigue of individuals who do extensive amounts of swimming. The device is configured to optimally spread the fingers of each hand. The device is useable with one or more fingers and thumb, preferably the third and fourth digits on each hand thus evenly spreading the fingers.

One or more embodiments of the hand control device is formed with resilient type of material that returns to form as well as maintains its functional and mechanical characteristics after deformation. The device has specific entryways for the fingers. The device can be worn and carried by the user or it can be appropriately stored in the individual's carrying case.

Figure 1B:
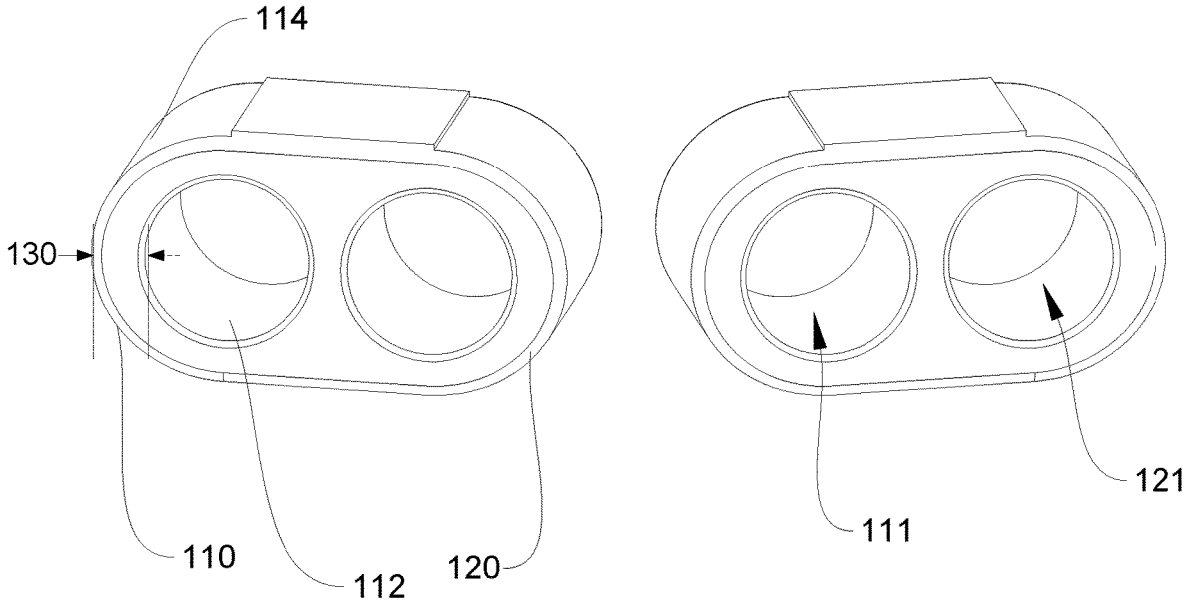
FIG. 1B is a side view of the hand control device in accordance with one or more embodiments of the present invention.

FIGS. 1A and 1B are various views of a hand control device 100 in accordance with one or more embodiments of the present invention. As illustrated, the hand control device 100 comprises an oval shaped body with two or more holes, 111 and 121, in a side-by-side configuration. Other configurations may include a single hole, for instance, for the third digit. Those of skill in the art would appreciate that the body may be rectangular, round, or any other suitable shape. For instance, the body could comprise a single ring or two or more rings coupled together in a side-by-side configuration.

In one or more embodiments, hole 111 is associated with ring 110 and hole 121 is associated with ring 120. The inside diameter of each hole, e.g. 111 and 121, is configured to snugly fit a person's finger or thumb and comprises a depth that relatively encircles the base portion of the selected digit of a person's hand. Each ring, e.g. 110, further comprises an inside surface 112 and an outside surface 114. The inside surface 112 of each ring comprises a smooth surface.

The body of each ring is configured to provide optimum separation of the fingers.

Figure 2A:
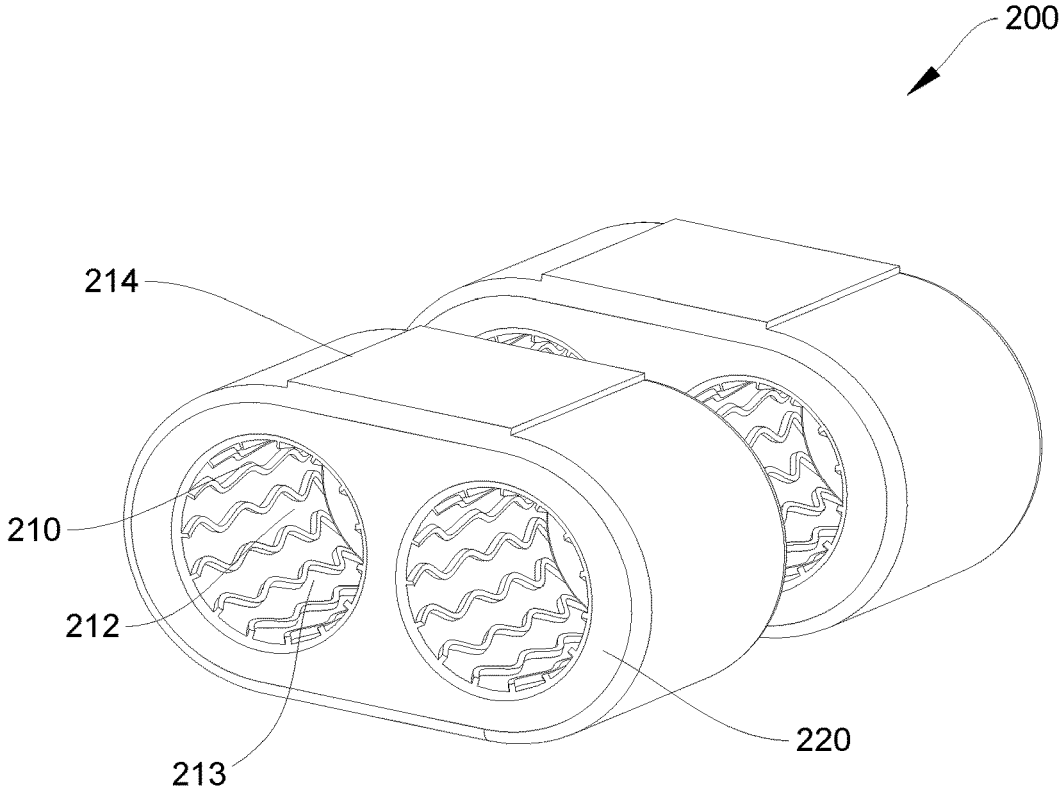
FIG. 2A is a perspective view of the hand control device with traction grooves in accordance with one or more embodiments of the present invention.
Figure 2B:
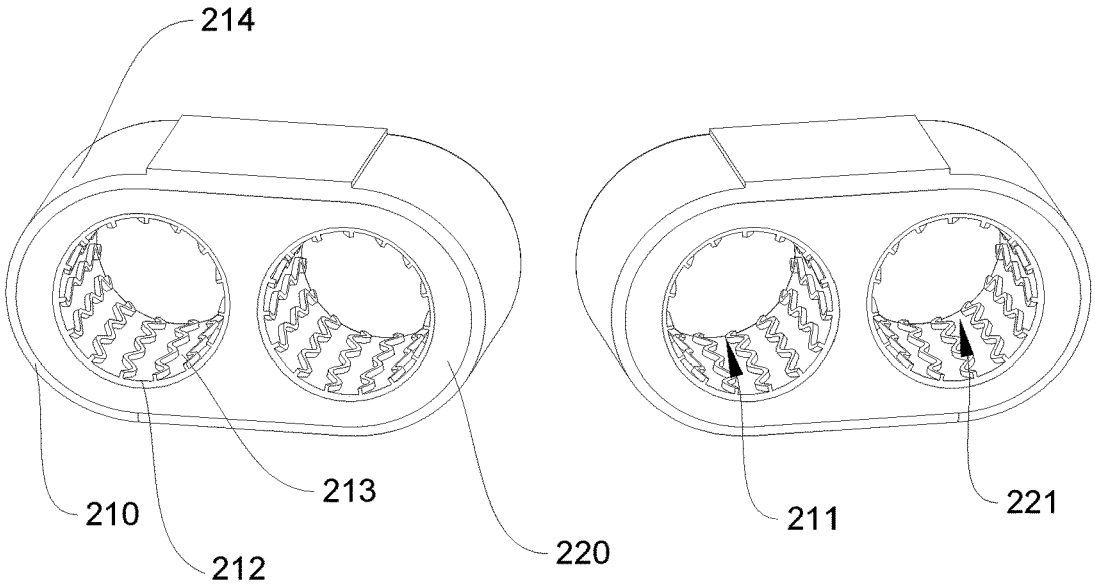
FIG. 2B is a side view of the hand control device with traction grooves in accordance with one or more embodiments of the present invention.

FIGS. 2A and 2B are various views of a hand control device with traction grooves 200 in accordance with one or more embodiments of the present invention. As illustrated, the hand control device 200 comprises an oval shaped body with two or more holes, 211 and 221, in a side-by-side configuration. Those of skill in the art would appreciate that the body may be rectangular, round, or any other suitable shape. For instance, the body could comprise a single ring or two or more rings coupled together in a side-by-side configuration.

In one or more embodiments, hole 211 is associated with ring 210 and hole 221 is associated with ring 220. The inside diameter of each hole, e.g. 211 and 221, is configured to snugly fit a person's finger or thumb and comprises a depth that relatively encircles the base portion of the selected digit of a person's hand. Each ring, e.g. 210, further comprises an inside surface 212 in each hole, e.g. 211, and an outside surface 214. The inside surface 212 of each ring comprises a plurality of grooves 213 that are approximately sinusoidal in shape and run from the front of the ring to the back, i.e. the depth of the hole, e.g. 211. The irregular shaped grooves are configured to provide wet surface traction while minimizing the surface that impacts direct pressure on the nerves, vessels and tendons of the digits of the hand.

In one or more embodiments of the invention, the outside surface 214 of each ring may also include a plurality of elevated and flexible ridges (not shown). For instance, the ridges may be on the outside edges where each outside digit, e.g. 15 and 12, makes contact with the outside surface of a ring, e.g. 214. In one or more embodiments, the outside ridges run in the same direction as the grooves 213. In other embodiments, the outside ridges run around the body of the ring.

In one or more embodiments, the grooves 213 allow for water to flow through the device between the body of the finger and the inside surface of the ring thereby reducing the chance of the device slipping from the hand while swimming.

In one or more embodiments, thickness 130 of the body of the device between the inside surface and the outside surface at the corners is optimized to provide least drag while improving swim times. For instance, in some embodiments, the thickness of ring body at the corners and the dividing wall between holes is equal to or less than about: 1 mm, 2 mm, 3 mm, 4 mm, 5 mm, 6 mm, 7 mm, 8 mm, 9 mm, 10 mm, or ranges including and/or spanning the aforementioned values.

Figure 3:
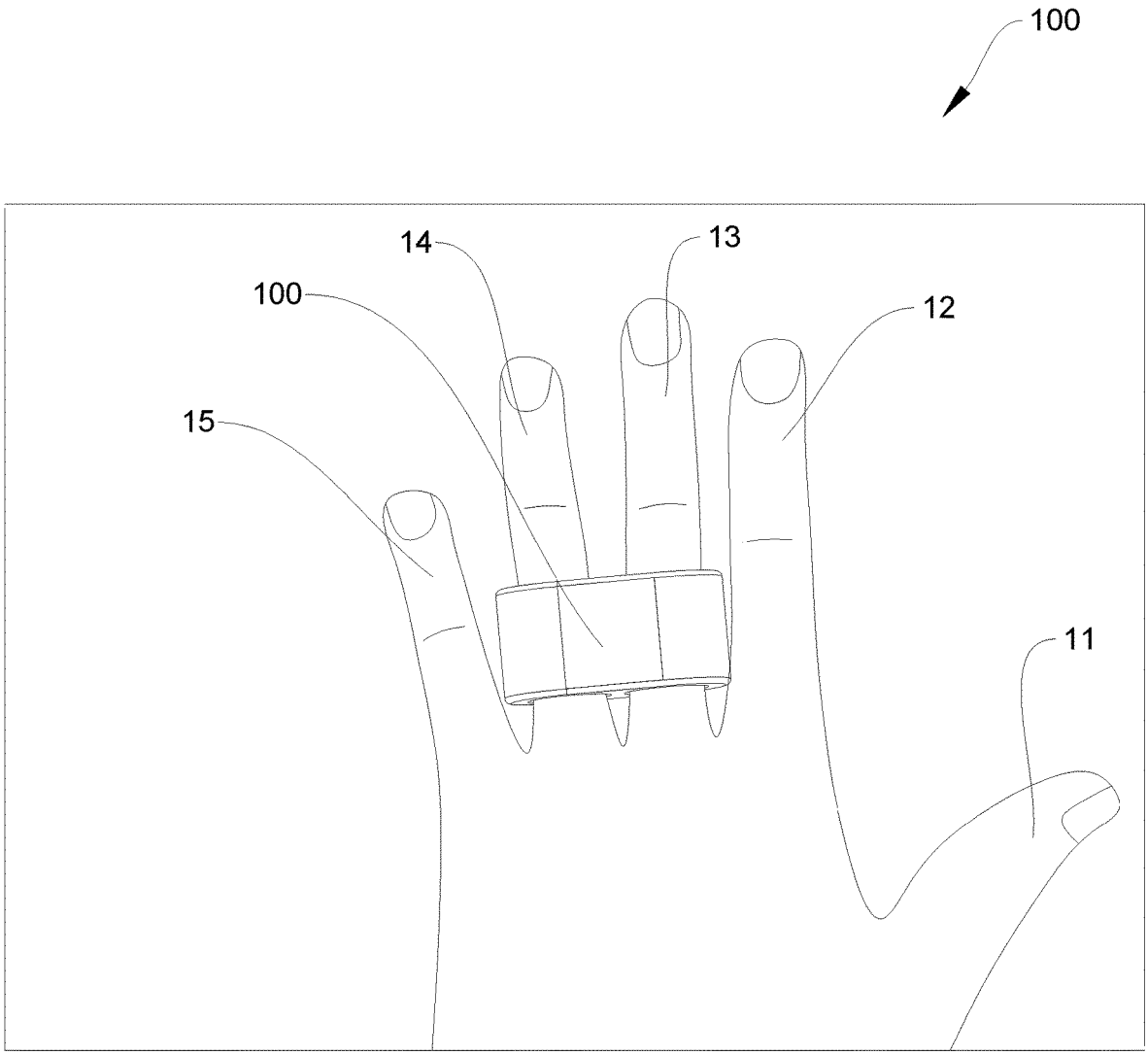
FIG. 3 is an illustration of an exemplary use of the hand control device to provide separation of the fingers for swimming in accordance with one or more embodiments of the present invention.

FIG. 3 is an illustration of an exemplary use of an embodiment of the hand control device of the present invention to provide separation of the fingers. As illustrated, a user may place each of two or more hand digits in each hole of the device, e.g. 111 and 121 (or 211 and 221), to effectuate optimum separation of the fingers. For instance, as illustrated in FIG. 3, the device 100 may be placed on hand 10 as follows: digit 14 of hand 10 is placed into hole 111 of ring 110; and digit 13 of hand 10 is placed into hole 121 of ring 210. In this configuration, the outside edge of ring 110 separates digit 15 (e.g. fifth digit or small finger) from digit 14 (e.g. fourth digit or ring finger); the wall between rings 110 and 120 separates digits 14 from 13 (e.g. third digit or middle finger); and the outside edge of ring 120 separates digit 13 from digit 12 (e.g. second digit or index finger). Other embodiments of the invention may add a third ring component (not shown) for the thumb (or first digit) 11, for example.

In one or more embodiments, the device may be attached to swimming aid devices such as paddles.

While the invention herein disclosed has been described by means of specific embodiments and applications thereof, numerous modifications and variations could be made thereto by those skilled in the art without departing from the scope of the invention set forth in the claims.

What is claimed is:

1. A hand control device for swimming comprising:

a main body with two circular apertures in a side-by-side configuration separated by a middle solid wall, wherein the first one of the two apertures is configured for a third digit of a person's hand and the second one of the two apertures is configured for a fourth digit of the hand, wherein the middle wall is configured to provide separation between the third digit and the fourth digit, wherein the main body comprises an outside wall on each side that is configured to provide separation between adjacent digits, wherein each aperture's inside surface comprises a plurality of grooves that run depthwise.

2. The hand control device of claim 1, wherein the plurality grooves are approximately sinusoidal in shape.

3. The hand control device of claim 1, wherein each ring's outside surface comprises one or more elevated and flexible outer ridges around the ring's outside facing perimeter.

4. The hand control device of claim 3, wherein the outer ridges are approximately sinusoidal in shape and run the depth of the surface of the ring.

5. The hand control device of claim 1, wherein the main body is formed with a resilient material.

* * * * *